United States Patent [19]

Keller

[11] Patent Number: 4,763,471

[45] Date of Patent: Aug. 16, 1988

[54] EXHAUST PLENUM CHAMBER

[75] Inventor: Jakob Keller, Dottikon, Switzerland

[73] Assignee: BBC Brown, Boveri & Company Limited, Baden, Switzerland

[21] Appl. No.: 11,347

[22] Filed: Feb. 2, 1987

Related U.S. Application Data

[63] Continuation of Ser. No. 723,279, Apr. 15, 1985, abandoned.

[30] Foreign Application Priority Data

Apr. 19, 1984 [CH] Switzerland ..... 1986/84

[51] Int. Cl.[4] ..... F01N 7/08

[52] U.S. Cl. ..... 60/312; 123/559.2; 181/227; 181/233

[58] Field of Search ..... 60/312, 313, 324, 280; 123/559 A; 181/227, 233; 138/121, 137, 139, 148

[56] References Cited

U.S. PATENT DOCUMENTS

| | | | |
|---|---|---|---|
| 2,110,986 | 3/1938 | Kadenacy | 60/324 |
| 2,875,787 | 3/1959 | Evans | 181/233 |
| 3,180,077 | 4/1965 | Berchtold | 60/313 |
| 3,237,715 | 3/1966 | Peters | 181/233 |
| 4,314,621 | 2/1982 | Hansen | 181/233 |
| 4,540,064 | 9/1985 | Fujimura | 181/227 |

FOREIGN PATENT DOCUMENTS

| | | | |
|---|---|---|---|
| 18017 | 2/1981 | Japan | 60/324 |

*Primary Examiner*—Douglas Hart

*Attorney, Agent, or Firm*—Oblon, Fisher, Spivak, McClelland & Maier

[57] ABSTRACT

An exhaust plenum chamber for a supercharged engine having a variable volume. A mechanical spring is arranged to an exhaust plenum chamber to increase the spring action of the plenum chamber volume. In this connection, the plenum chamber interior is divided into a flow chamber and a dead volume. The efficiency especially of relatively small plenum chambers in internal combustion engines with a small number of cylinders and/or slight supercharging is improved.

3 Claims, 1 Drawing Sheet

EXHAUST PLENUM CHAMBER

This application is a continuation of application Ser. No. 723,279, filed on Apr. 15, 1985, now abandoned.

BACKGROUND OF THE INVENTION

1. Field of the Invention

This invention relates generally to an exhaust plenum chamber and more particularly to an exhaust plenum chamber for an internal combustion engine supercharged by a gas-dynamic pressure-wave machine.

2. Discussion of Background

The purpose of such an exhaust plenum chamber, on the one hand, is to collect the exhaust mass flows which is given off by the individual cylinders of an engine. On the other hand, the exhaust chamber reduces the pulsations caused by an engine. The reduction action is of particular importance when an engine is supercharged with a gas-dynamic pressure-wave machine. Overly strong exhaust pulsations can considerably affect the supercharging process in the pressure-wave machine, because they cause fluctuations of the wave propagation time. For the mode of operation of a pressure-wave machine, reference is made to CH-PS No. 378 595 or to the printed publication CH-T No. 123 143 of the applicant.

Now, however, the choice of the volume of an exhaust receiver represents a compromise in each case. On the one hand, a large volume is advantageous, because the reduction of pulsations becomes greater with increasing volume. But on the other hand, a large volume results in a delayed response of the supercharger to load and speed variations, because the time for scavenging the exhaust plenum chamber increases with increasing volume. Such a compromise is particularly difficult in the case of slightly supercharged engines with a small number of cylinders. In engines with a small number of cylinders, the smoothing action on the exhaust pulsations by the collection of the partial mass flows given off by the individual cylinders is poor or even nonexistent. Moreover, the pulsation frequency is low and makes a correspondingly large receiver volume necessary for an effective reduction. There is also the fact that the efficiency of the exhaust plenum chamber becomes poorer with decreasing supercharging. An almost insoluble problem is faced, for example, in arriving at this compromise in the case of a slightly supercharged two-cylinder diesel engine.

SUMMARY OF THE INVENTION

Accordingly, one object of this invention is to provide a novel exhaust plenum chamber.

Another object of this invention is to provide a novel exhaust plenum chamber for a supercharged internal combustion engine.

A further object of this invention is to provide a novel exhaust plenum chamber with a spring member.

A still further object of this invention is to provide a novel exhaust plenum chamber having an interior which is divided into a flow chamber and a dead volume.

Another object of this invention is to provide a novel exhaust plenum chamber with an improved efficiency especially in engines with a small number of cylinders or a slight degree of supercharging.

Briefly these and other objects of the invention are achieved by providing a plenum chamber with a spring member around the walls defining the flow path through the chamber. In a second embodiment, the spring member forms these walls. The spring action acting on the plenum chamber contents causes a reduction of pressure pulsations in direct proportion to the spring action but not in proportion to the volume of the chamber. Thus the work of the chamber may be improved with a small plenum volume.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

All the elements that are not essential for understanding the invention as, for example, the internal combustion engine, the pressure-wave machine and ducts belong to it are omitted. The direction of flow of the engine exhaust is indicated by arrows.

Figure 1:
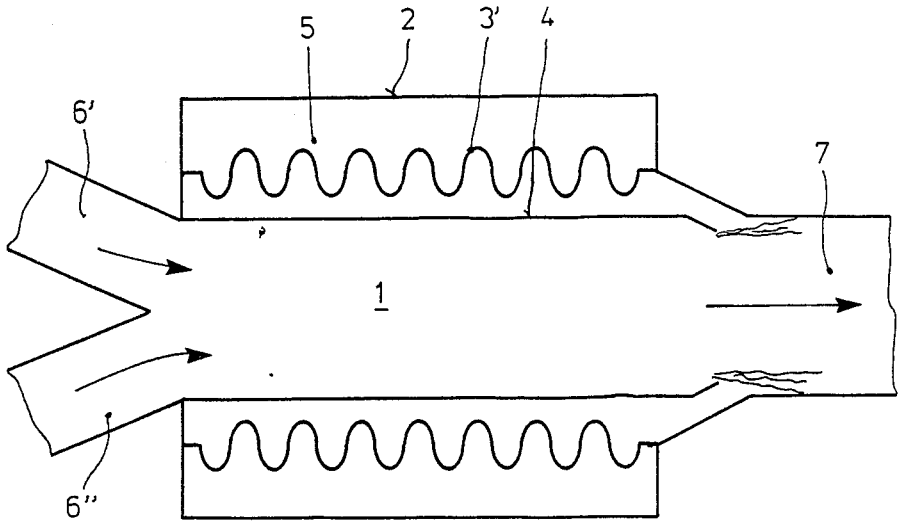
FIG. 1 shows a first embodiment of the subject exhaust plenum chamber.

Referring now to the drawings where like reference numerals designate identical or corresponding parts throughout the several views, and more particularly to FIG. 1 thereof, wherein the exhaust plenum chamber is shown as consisting essentially of an inner chamber 1, through which the gas flows, and an outer sound shield 2. Inflow ducts 6′, 6″ from the cylinders and outflow duct 7 to the pressure-wave machine are shown very simplified. The mechanical spring means here is an undulated spring steel membrane 3′ which extends over the entire active length of the plenum chamber and is clamped to its front side. The clamping is gas-tight. Membrane 3′ runs between flow-limiting wall 4 of chamber 1 and sound shield 2 and forms a dead volume 5 with the latter. The fact that another space, through which there is no flow, is between chamber 1 and membrane 3′ is not essential to the invention in the present connection.

The basic idea of the invention is to keep the total volume of the plenum chamber as small as possible by increasing the spring action of the plenum chamber contents.

If the incoming mass flow from ducts 6′, 6″ is indicated by $Q_1$ and the outgoing mass flow in duct 7 by $Q_2$, then the quasi-stationary continuity equation is $$Q_1 - Q_2 = V_R \cdot \frac{dj'}{dt} + j \cdot \frac{dV_R}{dt}$$

where $V_R$ signifies the plenum volume and j′ the gas density in the plenum chamber.

The second term on the right side of this equation would be ascribable to the mechanical spring action of the volume. If the characteristic frequency of this spring is essentially greater than the pulsation frequency, then $$\frac{dV_R}{V_R} = k \cdot \frac{dj}{j}$$

where k is a dimensionless "spring constant." For the example of a two-cylinder engine, k should correspond at least to two to four times the value of $V_H/V_R$, where $V_H$ signifies the swept volume of the engine.

Figure 2:
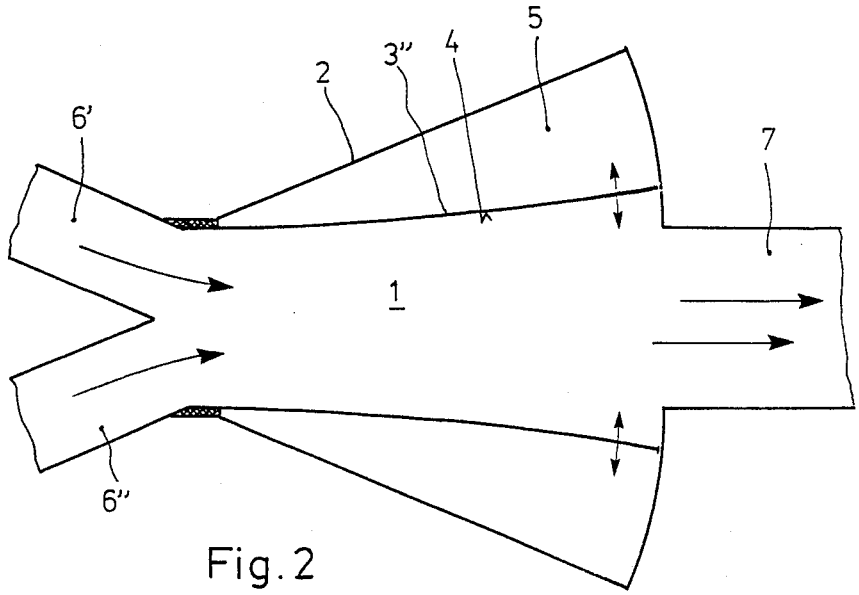
FIG. 2 shows a second embodiment of the subject plenum chamber.

In the embodiment shown in FIG. 2, in which the same elements have the same reference numbers as in FIG. 1, flow-limiting walls 4 are formed by the spring means themselves. Here spring steel sheets 3″ are involved, which are clamped on the intake side of the plenum chamber. On the outgoing side, the sheet ends pass with slight play on the front side of the plenum limit, which is curved for this purpose. Leakages caused by play, which flow around the spring sheet into dead volume 5, cause only negligible disturbances because of the relatively high pulsation frequency.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An internal combustion engine supercharged with a gas-dynamic pressure-wave machine having an exhaust collector comprising;

an outer sound shield closed against the atmosphere and rigidly connected at one end to a plurality of inflow ducts from cylinders of the engine and at the other end to an outflow duct leading to the pressure-wave machine;

an inner mechanical spring arranged inside said sound shield;

a dead volume formed between said sound shield and said spring; and a flow chamber formed within said spring;

wherein the volume of the flow chamber is varied by the action of said spring.

2. The exhaust collector according to claim 1, wherein said spring is formed from an undulated spring steel membrane which extends the length of the collector and is attached thereto in a gas-tight fashion.

3. The exhaust collector according to claim 1, wherein said spring is formed from spring steel sheets which are attached to the collector at the incoming end and movable in an arc at the outgoing end.

* * * * *